US008014871B2

(12) United States Patent
Dalton et al.

(10) Patent No.: US 8,014,871 B2
(45) Date of Patent: Sep. 6, 2011

(54) IMPLANTABLE INTERFEROMETER MICROPHONE

(75) Inventors: James Dalton, Beecroft (AU); Allira Gofers, Dundas Valley (AU)

(73) Assignee: Cochlear Limited, Macquarie University, NSW (AU)

( * ) Notice: Subject to any disclaimer, the term of this patent is extended or adjusted under 35 U.S.C. 154(b) by 255 days.

(21) Appl. No.: 11/650,456

(22) Filed: Jan. 8, 2007

(65) Prior Publication Data

US 2007/0161848 A1 Jul. 12, 2007

Related U.S. Application Data

(60) Provisional application No. 60/757,019, filed on Jan. 9, 2006.

(51) Int. Cl.
*H04R 25/00* (2006.01)

(52) U.S. Cl. ..... 607/55; 607/56; 600/25; 381/23.1

(58) Field of Classification Search ..... 607/55–56; 356/71.5, 73; 600/25; 381/23.1
See application file for complete search history.

(56) References Cited

U.S. PATENT DOCUMENTS 4,834,111 A * 5/1989 Khanna et al. ..... 600/587
5,360,388 A * 11/1994 Spindel et al. ..... 600/25
5,624,376 A * 4/1997 Ball et al. ..... 600/25
5,772,575 A 6/1998 Lesinski et al.
5,782,744 A 7/1998 Money
5,814,095 A 9/1998 Muller et al.
5,832,157 A * 11/1998 Berthold et al. ..... 385/51
5,859,916 A 1/1999 Ball et al.
5,881,158 A 3/1999 Lesinski et al.
5,888,187 A 3/1999 Jaeger et al.
5,973,906 A 10/1999 Stevenson et al.
5,999,632 A 12/1999 Leysieffer et al.
6,005,955 A 12/1999 Kroll et al.
6,068,590 A * 5/2000 Brisken ..... 600/25
6,093,144 A 7/2000 Jaeger et al.
6,174,278 B1 1/2001 Jaeger et al.
6,216,040 B1 4/2001 Harrison
6,259,951 B1 7/2001 Kuzma et al.
6,308,101 B1 10/2001 Faltys et al.
6,334,072 B1 12/2001 Leysieffer
6,381,336 B1 4/2002 Lesinski et al.
6,422,991 B1 7/2002 Jaeger
6,477,406 B1 * 11/2002 Turcott ..... 600/518
6,516,228 B1 2/2003 Berrang et al.
6,537,200 B2 3/2003 Leysieffer et al.
6,554,761 B1 4/2003 Puria et al.
6,554,762 B2 4/2003 Leysieffer
6,592,512 B2 7/2003 Stockert et al.
6,626,822 B1 9/2003 Jaeger et al.

(Continued)

*Primary Examiner* — Niketa I Patel
*Assistant Examiner* — Joseph Stoklosa
(74) *Attorney, Agent, or Firm* — Kilpatrick Townsend & Stockton, LLP

(57) ABSTRACT

A prosthetic hearing device comprising a biocompatible housing having a surface that vibrates in response to sound waves traveling through tissue; and an interferometer mounted in the housing, the interferometer is constructed and arranged to generate a light beam that impinges on a reflective interior surface of the vibrating surface, and to receive light reflected from the reflective interior surface. The device detects ambient sound by impinging a light beam on a portion of the vibrating surface; receiving light reflected from the reflective portion; measuring the movement of the vibrating surface based on an interference pattern of the impinging and reflected light; and determining at least a frequency of the incident sound wave based on the interference pattern.

30 Claims, 7 Drawing Sheets

U.S. PATENT DOCUMENTS 6,629,922 B1 10/2003 Puria et al.
6,629,923 B2 10/2003 Leysieffer
6,636,768 B1 10/2003 Harrison
6,695,761 B2 2/2004 Oschman et al.
6,697,674 B2 2/2004 Leysieffer
6,707,920 B2 3/2004 Miller
6,736,771 B2 5/2004 Sokolich et al.
6,826,430 B2 11/2004 Faltys et al.
6,842,647 B1 1/2005 Griffith et al.
6,879,695 B2 4/2005 Maltan et al.
6,980,864 B2 12/2005 Faltys et al.
7,043,304 B1 5/2006 Griffith et al.
7,054,691 B1 5/2006 Kuzma et al.
7,058,192 B2 6/2006 Muller et al.
7,092,763 B1 8/2006 Griffith et al.
7,136,706 B1 11/2006 Voelkel

* cited by examiner

IMPLANTABLE INTERFEROMETER MICROPHONE

CROSS-REFERENCE TO RELATED APPLICATIONS

The present application claims priority from U.S. Provisional Patent Application 60/757,019 entitled "Implantable Interferometer Microphone," filed Jan. 9, 2006, which is hereby incorporated by reference herein.

BACKGROUND

1. Field of the Invention

The present invention relates generally to prosthetic hearing devices, and more particularly, to an implantable interferometer microphone which may be utilized in prosthetic hearing devices.

2. Related Art

In recent years, rehabilitation of sensorineural hearing disorders with prosthetic hearing devices has acquired major importance. Such hearing disorder include, for example, various types of inner ear damage through complete postlingual loss of hearing or prelingual deafness, combined inner ear and middle ear damage, and temporary or permanent noise impressions (tinnitus).

Particular effort has been directed to providing some hearing capability to those persons for which hearing has completely failed due to accident, illness or other effects or for which hearing is congenitally non-functional. If, in such patients, only the inner ear (cochlea), and not the neural auditory path which leads to the brain, is impaired, the remaining auditory nerve may be stimulated with electrical stimulation signals to produce a hearing impression which can lead to speech comprehension. In these so-called cochlearm implants (also referred to as Cochlear™ devices, Cochlear™ implant systems, and the like; "cochlear implants" herein), an array of stimulation electrodes is inserted into the cochlea. This array is controlled by an electronic system which typically is surgically embedded as a hermetically sealed, biocompatible module in the bony area behind the ear (mastoid). The electronic system essentially contains a decoder and driver circuitry for the stimulation electrodes. Acoustic sound reception, conversion of the sound into analog electrical signals, and the processing of the analog signals, typically takes place in a so-called sound processor which is typically worn outside on the recipient's body. The sound processor superimposes the preprocessed signals, properly coded, on a high frequency carrier signal which, via inductive coupling, is transmitted (transcutaneously) to the implanted circuitry through the closed skin. In the above and other conventional prosthetic hearing devices, the sound-receiving microphone is also located outside of the recipient's body. In most conventional prosthetic hearing devices, the microphone is located in a housing of a behind-the-ear (BTE) component worn on the external ear, and is typically connected to the sound processor by a cable.

For some time there have been approaches to treat sensorineural and conducive hearing losses using totally implantable hearing aids. Such prosthetic hearing devices may offer better rehabilitation than conventional hearing aids. A common approach in such devices is to stimulate an ossicle of the middle ear or, directly, the inner ear, via mechanical or hydromechanical stimulation rather than via an amplified acoustic signal as in conventional hearing aids, or electrically, as in cochlear implants. The actuator stimulus of these systems is accomplished with different physical transducer principles such as, for example, by electromagnetic or piezoelectric technologies. The advantage of these devices is seen mainly in a sound quality which is improved compared to that of conventional hearing aids. Such totally implantable electromechanical hearing aids are described, for example, by H. P. Zenner et al. "First implantations of a totally implantable electronic hearing system for sensorineural hearing loss", in HNO Vol. 46, 1998, pp. 844-852; H. Leysieffer et al. "A totally implantable hearing device for the treatment of sensorineural hearing loss: TICA LZ 3001", in HNO Vol. 46, 1998, pp. 853-863; and H. P. Zenner et al. "Totally implantable hearing device for sensorineural hearing loss", in The Lancet Vol. 352, No. 9142, page 1751.

Another type of totally implantable prosthetic hearing device is the bone anchored hearing aid (BAHA). BAHA is a surgically implantable system for treatment of hearing loss through direct bone conduction. It has been used as a treatment for conductive and mixed hearing losses as well as for the treatment of unilateral sensorineural hearing loss. Typically, BAHA is used to help people with chronic ear infections, congenital external auditory canal atresia and single sided deafness, as such persons often cannot benefit from conventional hearing aids. Such systems are surgically implanted to allow sound to be conducted through the bone rather than via the middle ear.

More recently, totally implantable cochlear implants have been developed for use alone or in combination with other technologies, such as the noted totally implantable hearing aid.

One challenge of implantable prosthetic hearing systems, particularly those that are substantially or totally implantable, is the use of a totally-implantable microphone. Some of the problems encountered with implantable microphones include difficulty optimizing the coupling of sound between the tissue and the device, size restrictions due to the space available in the target implant location such as the middle ear, and the need to deliver sufficient gain to aid severe hearing loss.

BRIEF DESCRIPTION OF THE DRAWINGS

Embodiments of the present invention are described herewith with reference to the accompanying drawings, in which.

SUMMARY

Figure 1:
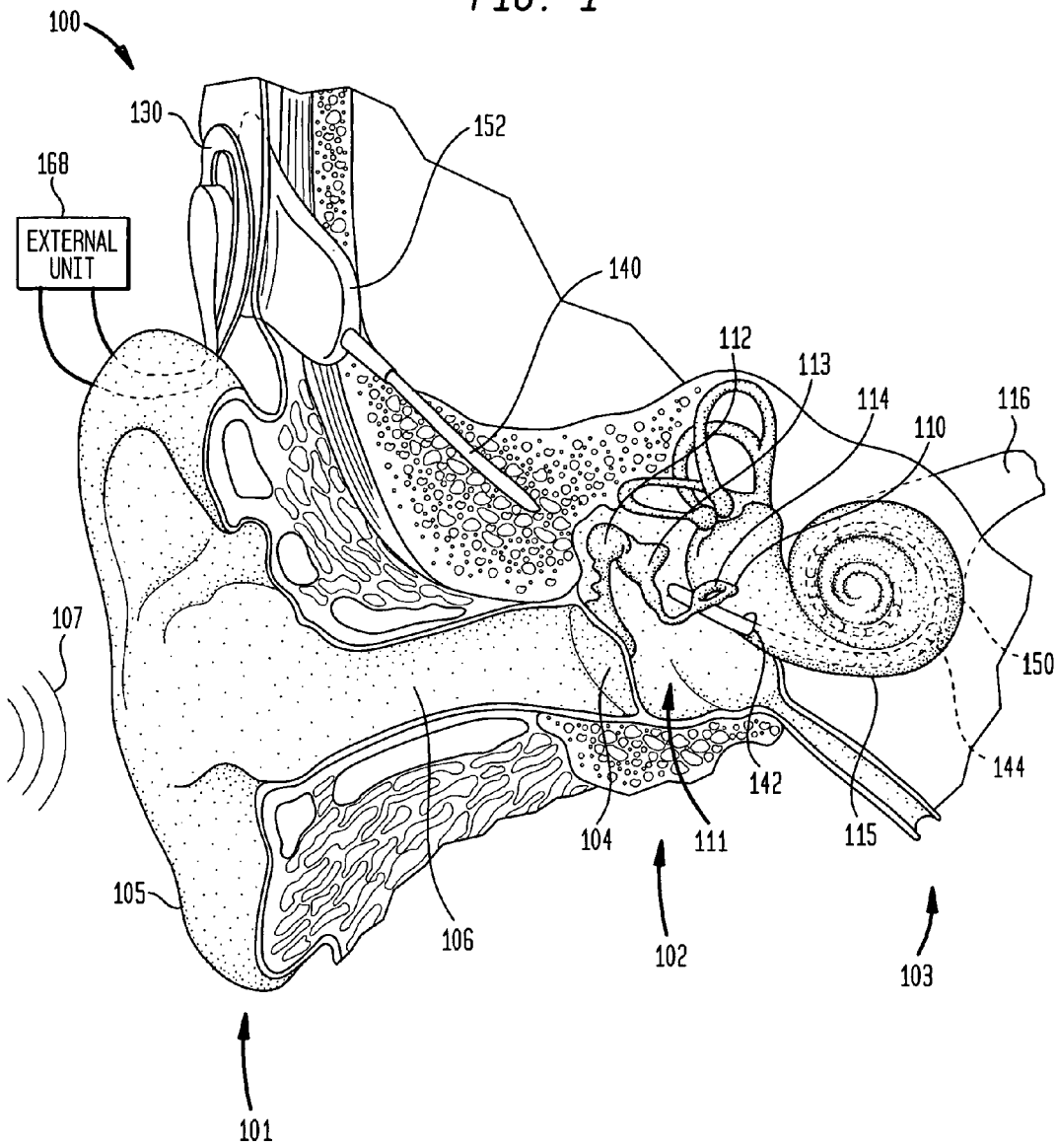
FIG. 1 is a diagram of an exemplary totally-implantable cochlear implant in which embodiments of the present invention may be advantageously implemented.

In accordance with one aspect of the present invention, a prosthetic hearing device is disclosed, comprising: a biocompatible housing having a surface that vibrates in response to sound waves traveling through tissue; and an interferometer mounted in the housing, the interferometer is constructed and arranged to generate a light beam that impinges on a reflective interior surface of the vibrating surface, and to receive light reflected from the reflective interior surface.

In accordance with another aspect of the present invention, a totally implantable interferometer microphone is disclosed, comprising: a biocompatible housing having a surface that vibrates in response to sound waves traveling through tissue; and an interferometer constructed and arranged to generate a light beam that impinges on an interior surface of said vibrating surface, and to receive light reflected from said reflective interior surface.

In accordance with a further aspect of the present invention, a method for detecting ambient sound in a prosthetic hearing device is disclosed, the method comprising: allowing an implanted surface to vibrate in response to the incidence of the ambient sound wave on the implanted surface; impinging a light beam on a portion of the vibrating surface; receiving light reflected from the reflective portion; measuring the movement of the vibrating surface based on an interference pattern of the impinging and reflected light; and determining at least a frequency of the incident sound wave based on the interference pattern.

DETAILED DESCRIPTION

The present invention is directed generally to the use of an interferometer to detect sound in an implantable component of a prosthetic hearing device. The use of an interferometer microphone results in a substantially more robust and sensitive prosthetic hearing device which may be configured to be operable within the space occupied by conventional cochlear implants. In conventional implantable microphones a thin diaphragm is often used to sense acoustic signals traveling through the surrounding tissue. These diaphragms are inherently sensitive to damage not only while being handled prior to implantation, but also while implanted. For example, such conventional microphones may be damaged by an impact to the head. In contrast, the interferometer microphone of the present invention has a sensitivity sufficient to allow sensing of sound signals from a much thicker and robust implant housing. Not only does this robustness provide certain embodiments with increased protection, it also makes such embodiments much less prone to variations in assembly, often a problem with the welding of thin diaphragms.

Exemplary embodiments of the present invention are further described below in conjunction with an exemplary prosthetic hearing device. In this illustrative application, the prosthetic hearing device is a totally implantable cochlear implant. It should be understood to those of ordinary skill in the art, however, that embodiments of the present invention may be used in other partially or completely implantable medical devices in which microphones are implemented.

FIG. 1 is a diagram of an exemplary totally-implantable cochlear implant in which embodiments of the present invention may be advantageously implemented. Depicted in FIG. 1 is a cut-away view of the relevant components of outer ear 101, middle ear 102 and inner ear 103. In a fully functional ear, outer ear 101 comprises an auricle 105 and an ear canal 106. An acoustic pressure or sound wave 107 is collected by auricle 105 and channeled into and through ear canal 106. Disposed across the distal end of ear cannel 106 is a tympanic membrane 104 which vibrates in response to acoustic wave 107. This vibration is coupled to oval window or fenestra ovalis 110 through three bones of middle ear 102, collectively referred to as the ossicles 111 and comprising the malleus 112, the incus 113 and the stapes 114. Bones 112, 113 and 114 of middle ear 102 serve to filter and amplify acoustic wave 107, causing oval window 110 to articulate, or vibrate. Such vibration sets up waves of fluid motion within cochlea 115. Such fluid motion, in turn, activates tiny hair cells (not shown) that line the inside of cochlea 115. Activation of the hair cells causes appropriate nerve impulses to be transferred through the spiral ganglion cells and auditory nerve 116 to the brain (not shown), where they are perceived as sound. In some deaf person, there is an absence or destruction of the hair cells. Prosthetic hearing device 100 is utilized to directly stimulate the ganglion cells to provide a hearing sensation to such persons.

FIG. 1 also shows how totally-implantable cochlear implant 100 is implanted in the recipient. Implant 100 comprises an implantable unit 152 temporarily or permanently implanted in the recipient. Implantable unit 152 comprises a microphone (not shown) for detecting sound, a speech processing unit (also not shown) that generates coded signals which are provided to a stimulator unit (also not shown) that applies the coded signal along electrode assembly 140. Electrode assembly 140 enters cochlea 115 at, for example, cochleostomy region 142 and has one or more electrodes 150 positioned to substantially be aligned with portions of tonotopically-mapped cochlea 115. Signals generated by implantable unit 152 are applied by electrodes 150 to cochlea 115, thereby stimulating the auditory nerve 116. It should be appreciated that although in the embodiment shown in FIG. 1 electrodes 150 are arranged in an array 144, other arrangements are possible.

An external unit 168 may be utilized to charge via a transcutaneous link a battery (not shown) included in cochlear implant 100. The transcutaneous link comprises an external coil 130 and an internal coil (not shown) included in implant assembly 152. The internal and external coils transmit power and coded signals to configure, monitor, and charge implant assembly 152. In certain embodiments, implantable unit 152 is connected, through RF transmission, to an external device such as a PC where the output can be read and compared to a calibrated input. This also enables any system upgrades to be uploaded from the PC to the integrated circuit.

Figure 2A:
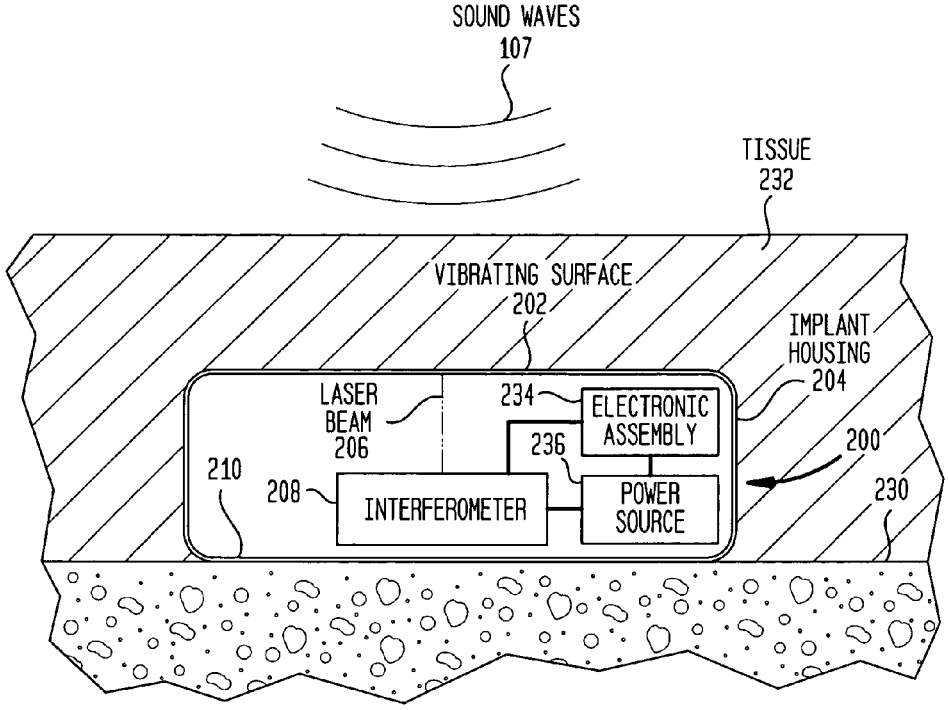
FIG. 2A is a schematic block diagram of an embodiment of an interferometer microphone of the present invention.

FIG. 2A is a schematic block diagram of an exemplary embodiment of implant assembly 152, referred to herein as implant assembly 200. In accordance with the teachings of the present invention, implant assembly 200 implements an embodiment of an interferometer microphone of the present invention. Implant assembly 200 has a biocompatible housing 204 in which an interferometer 208, an electronic assembly 234 and, in this embodiment, a power source 236 are housed. Implant housing 204 is manufactured from one or more biocompatible materials including but not limited to metals and their alloys; polymers and polymer composites; and/or ceramics and carbon-based materials. Utilization of other materials that satisfy the requirements of being biologically acceptable to the host tissue and remaining stable and functional are also contemplated, and are considered to be within the scope of the present invention.

Electronic assembly 234 comprises, for example, integrated circuits that perform conventional operations associated with the implanting prosthetic hearing device; that is, cochlear implant 100 in this illustrative application. Such operations and functions may include, but are not limited to, for example, signal processing, RF transmission to and from external unit 168, power regulation and electrode stimulation. In certain embodiments, a power source 236 is also included within housing 204. In the embodiment shown in FIG. 2A, the various components that perform these operations are collocated in a single subassembly housing referred to as electronic assembly 234. It should be appreciated, however, that such electronic components may be distributed individually or collectively within housings 204 or, alternatively, in more than one implant housing. It should further be appreciated that certain components may be located external to the recipient.

In the exemplary application shown in FIG. 2A, implant housing 204 is embedded in tissue 232 so that a base wall 210 of implant housing 204 is proximate to a bone or other rigid body structure such as, for example mastoid 230. Sound waves 107 pass through tissue 232 and strike vibrating surface 202 of housing 204. Interferometer 208 is directly or indirectly secured to base wall 210, opposite vibrating surface 202. A laser beam 206 generated by an He/Ne laser or its equivalent is emitted from interferometer 208. Laser beam 206 is reflected off of the interior of vibrating surface 202, with the light interference being detected by interferometer 208. The interference pattern is processed and converted into electrical signals which are then provided to electronic assembly 234. The relationship between the vibrations of vibrating surface 202 to the properties of the incident sound wave 107 will allow the frequencies present in the sound wave to be determined from the resulting measurements. This data can then be used as the sound input for totally implantable cochlear implant 100 or other prosthetic hearing device such as an implantable hearing aid. Electronic assembly 234 then processes the electrical signals as it would analog signals generated by a conventional microphone. Thus, it should be understood that interferometer 208 includes functionality suitable for generating such an electrical signal based on the detected interference.

Preferably, implant housing 200 is fixedly secured in direct contact with mastoid 230 to facilitate efficient sound transfer to the device. It should be appreciated, however, that other techniques may be implemented to obtain an intimate contact between device 200 and mastoid 230. For example, in other embodiments there is a gap between device 200 and mastoid 230. Such a gap will fill with bodily fluids over time. The presence of body fluid between device 200 and tissue 232 and/or bone 230 facilitates sound transfer.

Because the entire implant 200 is in the field of sound waves 107, vibrating surface 202 may comprise a substantial portion of housing 204. The ability of the entire housing 204 to vibrate provides design flexibility not provided in conventional devices. For example, virtually any internal surface of housing 204 may be used to detect sound. As such, the optimal portion of housing 204 may be selected based on orientation and location of implant assembly 152, or, alternatively, more than one surface may be used. Also, the need to dedicate a portion of the surface area of conventional devices to a sound sensing membrane is not required in systems implementing such embodiments of the present invention. Regardless of the location or quantity of vibrating surfaces, interferometer 208 is preferably isolated from housing 204 to insure there is a measurable difference in amplitude and phase between interferometer 208 and vibrating surfaces 202.

Figure 2B:
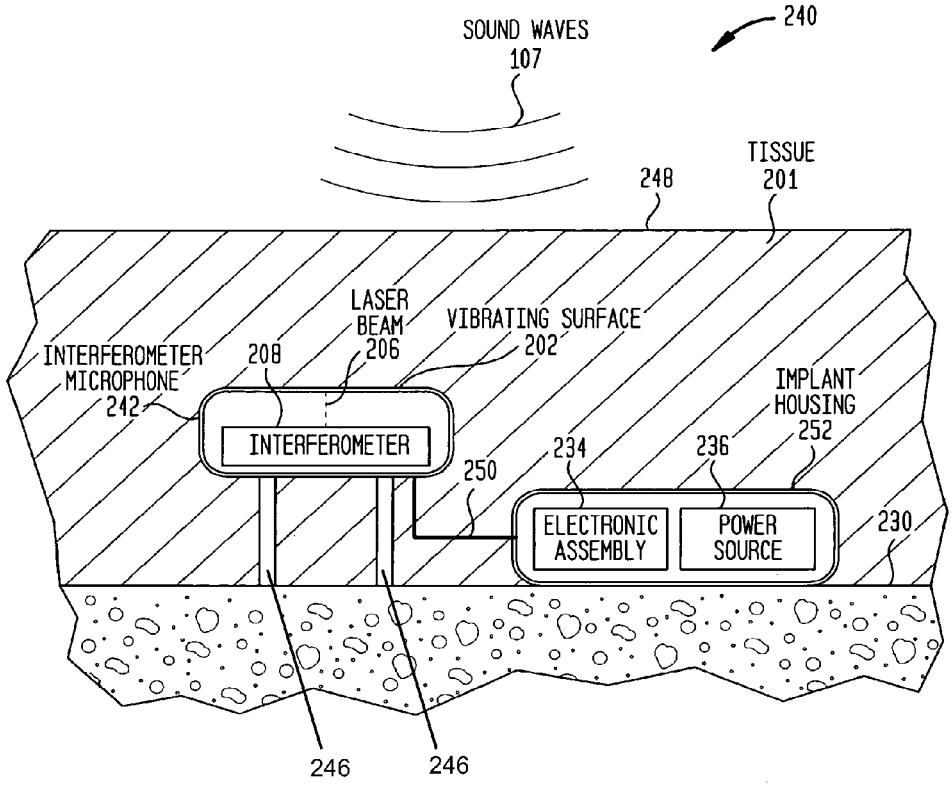
FIG. 2B is a schematic block diagram of another embodiment of an interferometer microphone of the present invention.

Preferably, the components of the interferometer microphone of the present invention are collocated with electronic assembly 234 in the same housing 204. It should be appreciated that this is arrangement is advantageous in that it results in a single implantable unit. It should also be appreciated, however, that in some applications, there may be reasons for separating the interferometer microphone from the main implant housing. One of these would be in applications where the size of the microphone dictates that it be separate from the electronics module. Another would be applications in which it may be beneficial to position the microphone in an area where the signal strength is greater, or where the natural acoustics of the outer ear can be utilized to advantage. FIGS. 2A and 2B are exemplary embodiments of such an arrangement.

Figure 2C:
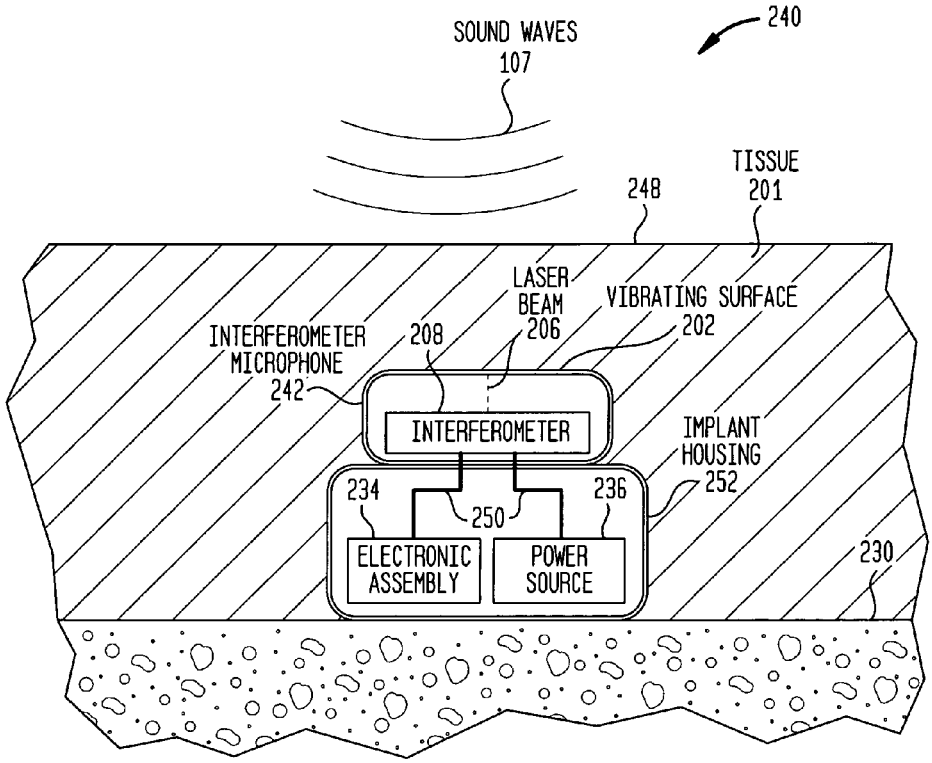
FIG. 2C is a schematic block diagram of further embodiment of an interferometer microphone of the present invention.

FIGS. 2B and 2C are alternative embodiments of the implantable interferometer microphone of the present invention. In FIGS. 2B and 2C, components of an embodiment of the interferometer microphone are housed separately from the components comprising power supply 236 and electronic assembly 234. In FIG. 2B, prosthetic hearing device 240 comprises an interferometer microphone 242 that is not located in the same housing with power supply 236 and electronic assembly 234 which are separately housed in housing 252.

In this embodiment, interferometer microphone 242 comprises an interferometer 208 secured within a housing 244 having a vibrating surface 202. In this example, interferometer microphone 242 is secured to bone 230 via spacers 246. Raising interferometer microphone 242 off of the surface of bone 230 positions vibrating surface 202 in closer proximity to surface 248 of tissue 201. Interferometer microphone 242 is operationally coupled to the remaining components of device 240 via lead line(s) 250.

In the embodiment shown in FIG. 2C, interferometer microphone 242 is mounted on the surface of housing 252 to attain a closer proximity to tissue surface 248 without implementation of legs 246 as shown in FIG. 2B. It should be appreciated, however, that embodiments of the interferometer microphone of the present invention need not have close proximity to the tissue surface on which sound waves 107 impinge due to the sensitivity of the microphone. It should also be appreciated that interferometer microphone of the present invention may be separately housed for a variety of reasons, some of which have been noted herein.

As noted, interferometer 208 measures the movement of vibrating surface 202. Interferometer 208 may be any device now or later developed that uses an interference pattern to determine wave frequency, length, or velocity. In certain embodiments described herein, interferometer 208 is an interferometer that uses a laser as its light source. The purely monochromatic nature of a laser results in improved efficiency and overall performance of the device. It should be appreciated that although preferable, a light source other than a laser may be implemented in alternative embodiments depending on the requirements of the particular application.

In particular embodiments, interferometer 208 is a fiber-optic dynamic interferometer. The interference of light underlies many high-precision measuring systems and displacement sensors and the incorporation of optical fibers allows for the reduction in size and cost. In certain embodiments, the fiber optic interferometers comprise: Mach-Zehnder and Fabry-Perot interferometers. In fiber optic interferometers the interference occurs between the partially reflecting end of the fiber and an external mirror or other reflective surface. The size of the sensitive element using fiber optics can be as small as diameter of the fiber, that is, about 0.1 mm, and the sensitivity can achieve sub-angstrom level. The use of fiber optics eliminates the concern regarding sensitivity to electro-magnetic interference as well as enabling the device to be implemented in hostile environments. Furthermore, in certain embodiments, the laser interferometer preferably uses optical fiber sensors, eliminating the need to dedicate a portion of the surface area of conventional devices to serving as a sound sensing membrane.

In one embodiment, interferometer 208 is a 100 Hz-10,000 Hz laser interferometer using optical fiber sensors. As one of ordinary skill in the art would appreciate, however, any other types of interferometers or now or later developed may be implemented in alternative embodiments. An example of an applicable interferometer is a heterodyne interferometer, with an acousto-optic modulator (Bragg cell) on one arm, which provides the advantage that it is less susceptible to hum and noise. Another example would be a quadrature homodyne interferometer. Such an interferometer generally requires the addition of wave retardation plates, a polarizing beam splitter and a second detector. Alternative embodiments of the interferometer will be evident to those of ordinary skill in the relevant art.

The reflective interior of housing 204 is preferably attained due to the material of the housing and not a coated or additional layer of material. Therefore, preferred materials of manufacture for housing 204 include those that have a reflective surface, such as titanium. Alternatively, if housing 204 is formed of a non-reflective material, the interior of vibrating surface 202 is coated with an appropriate reflective material.

In one embodiment, housing 204 is sealed and maintained with a controlled atmosphere of an inert gas mixture such as helium and argon to prevent the ingress of body fluid in the event a fine opening occurs in housing 204. In one particular embodiment, housing 204 is maintained at or slightly above 1 atmosphere.

The use of interferometer 208 enables linear motion of vibrating surface 202 of a fraction of a nanometer to be accurately detected, increasing the frequency response of the implementing cochlear implant. Advantageously, this enables the recipient to sense more of the sound field in the tissue than conventional pressure microphones. Advantageously, because interferometer 208 measures the deflection of the implant housing, with deflections being proportional to tissue-borne sound, no special construction changes are required to the implant housing such as thin diaphragms, air cavities etc. As noted, it is preferable that the interferometer and other components such as mirror 340 in the embodiment illustrated in FIG. 3, described below, are isolated from the area where deflections are detected. If the interferometer also moves in phase with the vibrating surface then there may be a poor or weak signal. The isolation of the interferometer can be selected such that good signal strength can be achieved in the range 100 Hz-10,000 Hz, which encompasses the frequency range necessary for speech discrimination.

Figure 2D:
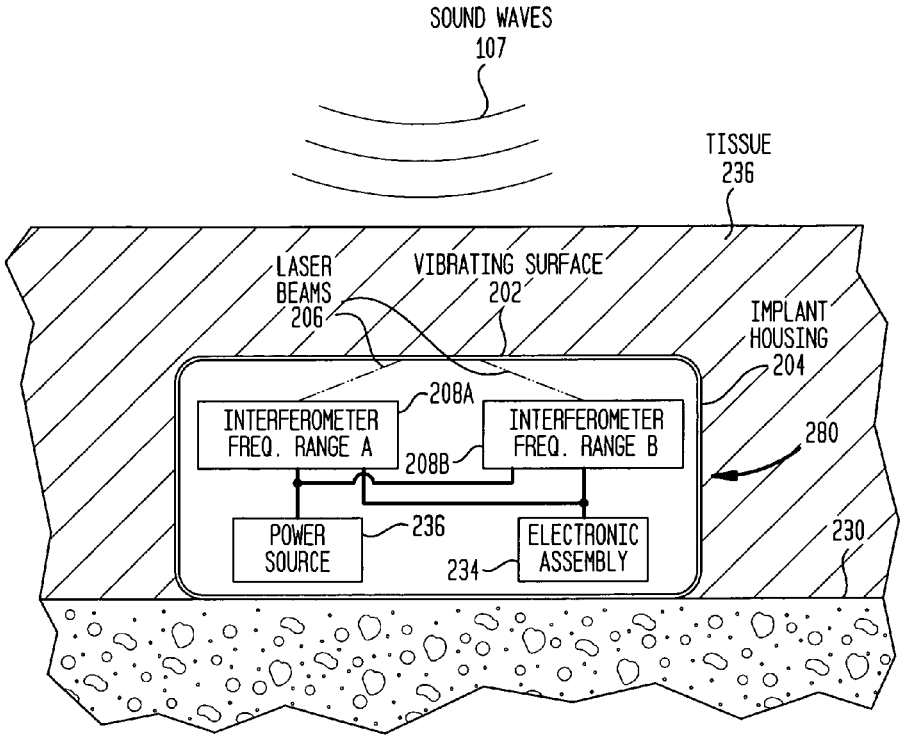
FIG. 2D is a schematic block diagram of another embodiment of an interferometer microphone in accordance with the present invention.

FIG. 2D is a schematic block diagram of another embodiment of the interferometer microphone of the present invention. In this embodiment, housing 280 comprises more than one interferometer microphone: one interferometer microphone 208A is configured to detect one frequency range of sound 107, and another interferometer microphone 208B is configured to detect another frequency range of sound 107. In this exemplary embodiment, both interferometers 208 detect vibrations of a single surface 202. It should be appreciated, however, interferometers 208 may detect vibrations from more that one vibrating surface, and that the vibrating surface measured by each interferometers may or may not be the same. It should also be appreciated that in alternative embodiments more than two interferometer microphones may be similarly utilized.

Figure 3:
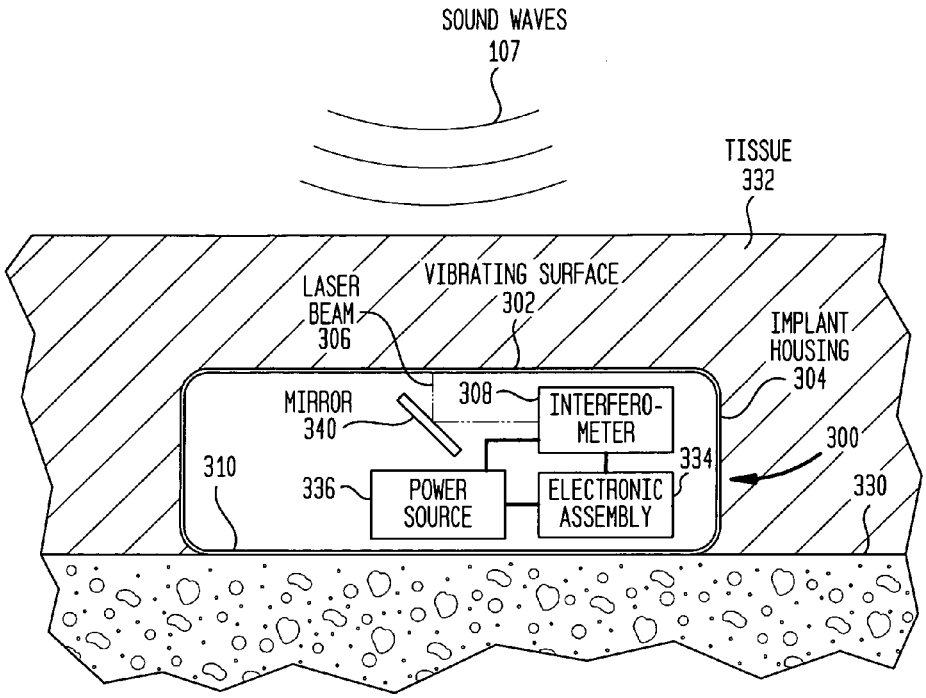
FIG. 3 is a schematic block diagram of another embodiment of an interferometer microphone of the present invention.

FIG. 3 is a schematic block diagram of an embodiment of implant assembly 152, referred to herein as implant assembly 300. Implant assembly 300 comprises another embodiment of an interferometer microphone of the present invention in which laser bean 306 is deflected by a mirror 340. In this embodiment, an interferometer 308 is placed on one side of housing 304 with the initiating laser beam 306 emitted substantially parallel to vibrating surface 302. Mirror 340 is placed at an angle within housing 304 to reflect laser beam 306 toward vibrating surface 302. The reasoning interference pattern is detected by interferometer 308 after the return of a reflected beam. For greatest accuracy, the reflected beam should be at right angles to the initiating beam and the angle of mirror 340 should be such that the right angle is achieved. This is optimally about a 45 degree angle relative to the path of laser beam 306. It should be appreciated, however, that slight variations can be corrected electronically.

In other embodiments, interferometer 208 and the electronic components 330 are at opposing sides of housing 304. In such an arrangement the depth of implant housing 304 can be less than that of housing 304.

Figure 4:
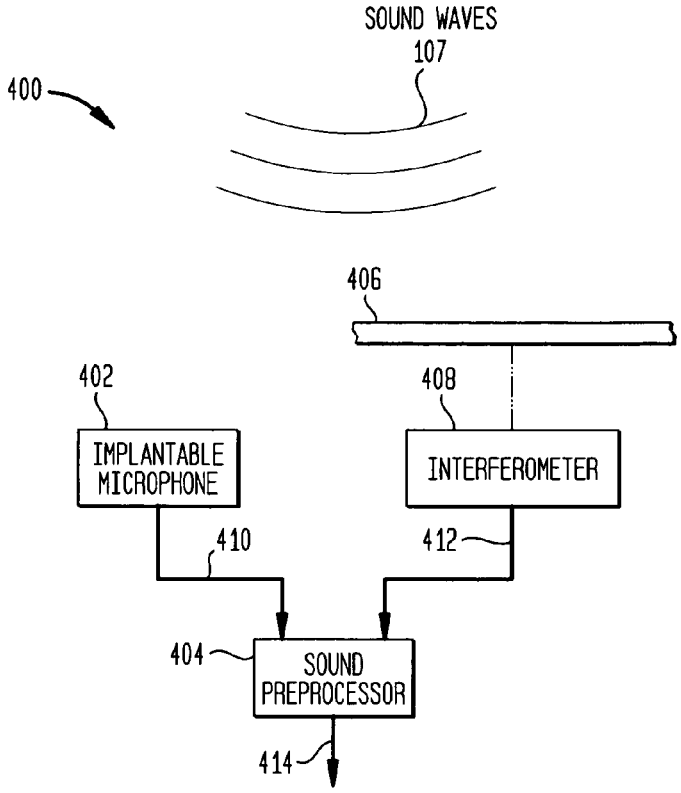
FIG. 4 is a schematic block diagram of another embodiment of an interferometer microphone of the present invention.

FIG. 4 is a functional block diagram of another embodiment of an interferometer microphone of the present invention. In this embodiment, interferometer 408 detects sound impinging on vibrating surface 406 of a housing (not shown), as described above. In this embodiment, interferometer 408 is implemented in conjunction with an internal microphone 402, located in the same or different housing as interferometer 408. Internal microphone 402 and interferometer 408 generate electrical signals 410, 412, respectively which are processed by a sound processor 404.

In order to detect airborne sound 107 from beneath the skin, implanted microphone 402 needs to be of high sensitivity. As a result, implanted microphone 402 also picks up body noises. Unfortunately, body noises are usually at levels and frequencies that can be annoying to the recipient.

To resolve this problem, in one embodiment, interferometer 408 is tuned to be sensitive to body noises. Sound processor 404 removes the body noises from signal 410 received from microphone 402 to generate a signal 414 representative of ambient sound 107. Signal 414 is then used for subsequent processing by other components (not shown) of the implementing prosthetic hearing device.

As one of ordinary skill in the art would appreciate, interferometer 408 may be utilized to perform functions other than the above body-noise sensing function when utilized in conjunction with internal microphone 402. It should also be appreciated that internal microphone 402 may be any internal microphone now or later developed.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention.

All documents, patents, journal articles and other materials cited in the present application are hereby incorporated by reference.

What is claimed is:

1. A prosthetic hearing device comprising:

a biocompatible housing comprising a surface configured to vibrate in response to sound waves when the housing is implanted in a recipient, wherein the vibrating surface comprises an exterior surface and a reflective interior surface; and a first interferometer, mounted in said housing, configured to generate a first light beam that impinges on said reflective interior surface of said vibrating surface, and to detect one frequency range of the sound waves via light reflected from said reflective interior surface; and a second interferometer, mounted in said housing, configured to generate a second light beam that impinges on said reflective interior surface of said vibrating surface, and to detect another frequency range of the sound waves via light reflected from said reflective interior surface.

2. The prosthetic hearing device of claim 1, further comprising: an electronic assembly connected to each of said interferometers.

3. The prosthetic hearing device of claim 2, wherein said electronic assembly is secured within said housing.

4. The prosthetic hearing device of claim 1, further comprising: a power source connected to each of said interferometers.

5. The prosthetic hearing device of claim 4, wherein said power source is secured within said housing.

6. The prosthetic hearing device of claim 1, wherein said housing is manufactured from one or more biocompatible materials from the group consisting of: metals and their alloys; polymers and polymer composites; ceramics; and carbon-based materials.

7. The prosthetic hearing device of claim 1, wherein said biocompatible housing is configured to be embedded in a tissue so that a base wall of said housing is proximate to a rigid body structure.

8. The prosthetic hearing device of claim 7, wherein said rigid body structure is bone.

9. The prosthetic hearing device of claim 1, wherein said first interferometer is one of the group comprising: a laser interferometer; and a fiber-optic dynamic interferometer.

10. The prosthetic hearing device of claim 1, wherein said first interferometer is one of the group comprising: a quadrature homodyne interferometer; and a heterodyne interferometer.

11. The prosthetic hearing device of claim 9, wherein said laser interferometer comprises: an He/Ne laser.

12. The prosthetic hearing device of claim 7, wherein said housing is configured to be fixedly secured in direct contact with said rigid body structure.

13. The prosthetic hearing device of claim 1, wherein said vibrating surface comprises a substantial portion of said housing.

14. The prosthetic hearing device of claim 1, wherein said vibrating surface is one of a plurality of vibrating surfaces, and wherein said first interferometer measures the vibration of each of said plurality of vibrating surfaces.

15. The prosthetic hearing device of claim 10, wherein said fiber optic interferometer comprises one of either a Mach-Zehnder and a Fabry-Perot interferometer.

16. The prosthetic hearing device of claim 9, wherein said laser interferometer is a 100 Hz-10,000 Hz laser interferometer comprising optical fiber sensors.

17. The prosthetic hearing device of claim 1, wherein said housing is sealed and maintained with a controlled atmosphere of an inert gas mixture.

18. A totally implantable interferometer microphone comprising:

a biocompatible housing comprising a surface configured to vibrate in response to sound waves when the housing is implanted in a recipient, wherein the vibrating surface comprises an exterior surface and a reflective interior surface; and a first interferometer, mounted in said housing, configured to generate a first light beam that impinges on said reflective interior surface of said vibrating surface, and to detect one frequency range of the sound waves via light reflected from said reflective interior surface; and a second interferometer, mounted in said housing, configured to generate a second light beam that impinges on said reflective interior surface of said vibrating surface, and to detect another frequency range of the sound waves via light reflected from said reflective interior surface.

19. The implantable interferometer microphone of claim 18, wherein said totally implantable interferometer microphone is configured to be implemented in a prosthetic hearing device.

20. The implantable interferometer microphone of claim 18, wherein said prosthetic hearing device is a cochlear implant.

21. The implantable interferometer microphone of claim 18, wherein said housing is manufactured from one or more biocompatible materials from the group consisting of: metals and their alloys; polymers and polymer composites; ceramics; and carbon-based materials.

22. The implantable interferometer microphone of claim 18, wherein said biocompatible housing is configured to be embedded in a tissue so that a base wall of said housing is proximate to a rigid body structure.

23. The implantable interferometer microphone of claim 18, wherein said first interferometer is one of the group comprising: a laser interferometer; a fiber-optic dynamic interferometer; a quadrature homodyne interferometer; and a heterodyne interferometer.

24. The implantable interferometer microphone of claim 18, wherein said vibrating surface comprises a substantial portion of said housing.

25. The implantable interferometer microphone of claim 23, wherein said fiber optic interferometer comprises one of either a Mach-Zehnder and a Fabry-Perot interferometer.

26. The implantable interferometer microphone of claim 18, wherein said housing is sealed and maintained with a controlled atmosphere of an inert gas mixture.

27. A method for detecting ambient sound in a prosthetic hearing device comprising a housing, the method comprising:

allowing an implanted surface of the housing to vibrate in response to the incidence of an ambient sound wave on the vibrating surface;

impinging a first light beam on a reflective interior portion of said vibrating surface using a first interferometer mounted in the housing;

impinging a second light beam on said reflective interior portion using a second interferometer mounted in the housing;

detecting, via light reflected from said reflective interior portion, one frequency range of the sound waves using said first interferometer; and detecting, via light reflected from said reflective interior portion, another frequency range of the sound waves using said second interferometer.

28. The method of claim 27, further comprising:

generating an electrical signal representative of said one frequency range of the sound waves.

29. The method of claim 27, further comprising:

generating an electrical signal representative of said another frequency range of the sound waves.

30. The device of claim 1, further comprising:

spacers configured to secure the housing to a rigid body structure such that a gap corresponding to the length of the spacers separates the rigid body structure from the housing.

* * * * *